US009283460B1

(12) United States Patent
Viera

(10) Patent No.: US 9,283,460 B1
(45) Date of Patent: Mar. 15, 2016

(54) TRAINING APPARATUS FOR STATIONARY BICYCLE ROLLERS

(71) Applicant: Justine Anne-Marie Viera, Fort Wayne, IN (US)

(72) Inventor: Justine Anne-Marie Viera, Fort Wayne, IN (US)

( * ) Notice: Subject to any disclaimer, the term of this patent is extended or adjusted under 35 U.S.C. 154(b) by 0 days.

(21) Appl. No.: 14/482,915

(22) Filed: Sep. 10, 2014

(51) Int. Cl.
*A63B 69/16* (2006.01)

(52) U.S. Cl.
CPC ..... *A63B 69/16* (2013.01); *A63B 2069/167* (2013.01); *A63B 2210/50* (2013.01)

(58) Field of Classification Search
CPC ..... A63B 31/00; A63B 31/005; A63B 31/04; A63B 1/00; A63B 1/005; A63B 1/04; A63B 3/00; A63B 23/0464; A63B 69/0028; A63B 69/0035; A63B 69/16; A63B 2069/0031; A63B 2069/0033; A63B 2069/0037; A63B 2210/50; A63B 2210/54; A63B 2210/56; A63B 2069/167; B65D 19/44
USPC ..... 482/910; 108/27, 55.1, 55.3
See application file for complete search history.

(56) References Cited

U.S. PATENT DOCUMENTS 3,159,116 A * 12/1964 Skubic ..... B65D 19/385 108/53.5
3,659,844 A * 5/1972 Cummins ..... A63B 21/023 273/DIG. 8
3,747,233 A * 7/1973 Berryman ..... A63B 23/0464 434/255
6,006,676 A * 12/1999 Creek ..... B65D 19/44 108/55.3
6,168,548 B1 * 1/2001 Fleming ..... A63B 3/00 482/38
6,238,320 B1 * 5/2001 Flanagan ..... A63B 3/00 482/130
7,060,009 B2 6/2006 Greenleaf
2004/0009845 A1 * 1/2004 Johnson ..... A63B 26/003 482/41
2006/0110716 A1 * 5/2006 Micari ..... A63B 69/18 434/253
2011/0166000 A1 * 7/2011 Wight ..... A63B 23/0464 482/17
2013/0102406 A1 * 4/2013 Yu ..... A63B 69/3623 473/278
2013/0331232 A1 * 12/2013 Kwo ..... A63B 1/00 482/38

* cited by examiner

*Primary Examiner* — Loan H Thanh
*Assistant Examiner* — Gregory Winter
(74) *Attorney, Agent, or Firm* — Bradley C. Fach; Steven R. Kick; PATENTFILE, LLC

(57) ABSTRACT

A training apparatus for stationary bicycle rollers includes a platform base with multiple panels and the panels are pivotally connected to each other and configured to fold together when not in use for ease of transportation and reduced storage space. The platform is configured to removably mate with an adjustable stabilization bar configured to provide stabilization support to a cyclist when using stationary bicycle rollers.

18 Claims, 6 Drawing Sheets

TRAINING APPARATUS FOR STATIONARY BICYCLE ROLLERS

FIELD OF THE INVENTION

The present invention relates to the field of bicycle training apparatuses. More specifically, the invention relates to training apparatuses for use with stationary bicycle roller training devices.

BACKGROUND

Stationary bicycle rollers are utilized by cyclists as part of their training and fitness regime. Rollers may comprise three parallel rotatable drums onto which a two wheeled bicycle may be placed. A cyclist may then mount the bicycle and commence pedaling allowing the bicycle wheels to rotate and to simulate training exercises. Unlike many stationary bicycle training devices, in order to gain the most benefit from the training exercises, it is desirable for the bicycle to be free standing on the rollers.

Riding a free standing bicycle on rollers can often times become challenging and even dangerous when using this equipment for the first time. Traditional rollers do not offer any sort of stabilization or method of being able to steady oneself when one becomes unstable while pedaling the bicycle on the rollers. While some cyclists will position the rollers next to a nearby surface such as a wall or furniture, there remains the inherent possibility of the bicycle swerving sideways off of the rollers or the cyclist becoming unbalanced and falling sideways off of the rollers and onto the nearby surface or ground. By falling off the rollers or the bicycle, the cyclist may sustain substantial injuries. Also, nearby surfaces such as walls, door frames, or floors may become damaged by the falling bicycle due to contact with the bicycle components such as the handlebars, pedals, or derailleur mechanism, and the bicycle itself may also sustain damage.

As a result of the perceived danger of using rollers, many cyclists will not even attempt to use rollers for the first time or they will avoid using rollers frequently as part of their training regime. This avoidance is especially true of beginning cyclists or experienced cyclists who are just beginning to learn how to use rollers.

Bicycle roller balance devices are known in the art, however, these devices are large, bulky, and are too difficult to move by one person. These devices are also limited where only certain makes and models of rollers may be used with the device. A further drawback of the current devices is that they take up substantial amounts of space even when not in use often requiring rooms and spaces to be dedicated solely to their storage.

Therefore, a need exists for novel training apparatuses for stationary bicycle rollers. There is a further need for training apparatuses for stationary bicycle rollers that are able to stabilize the cyclist to prevent injuries, damage to the bicycle, and damage to surrounding surfaces resulting from the cyclist or bicycle falling off of the rollers. A need also exists for training apparatuses for stationary bicycle rollers that alleviate the perceived danger of using rollers which may cause a cyclist to avoid using rollers. Finally, there exists a need for training apparatuses for stationary bicycle rollers that are able to be easily transported and that do not require significant amounts of storage room when not in use.

BRIEF SUMMARY OF THE INVENTION

In preferred embodiments, the training apparatus for stationary bicycle rollers comprises a platform base with multiple panels wherein the panels are pivotally connected to each other and configured to fold together when not in use for ease of transportation and reduced storage space. In further embodiments, the platform is configured to removably mate with an adjustable stabilization bar configured to provide stabilization support to a cyclist when using the stationary bicycle rollers.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New training apparatus for stationary bicycle rollers are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
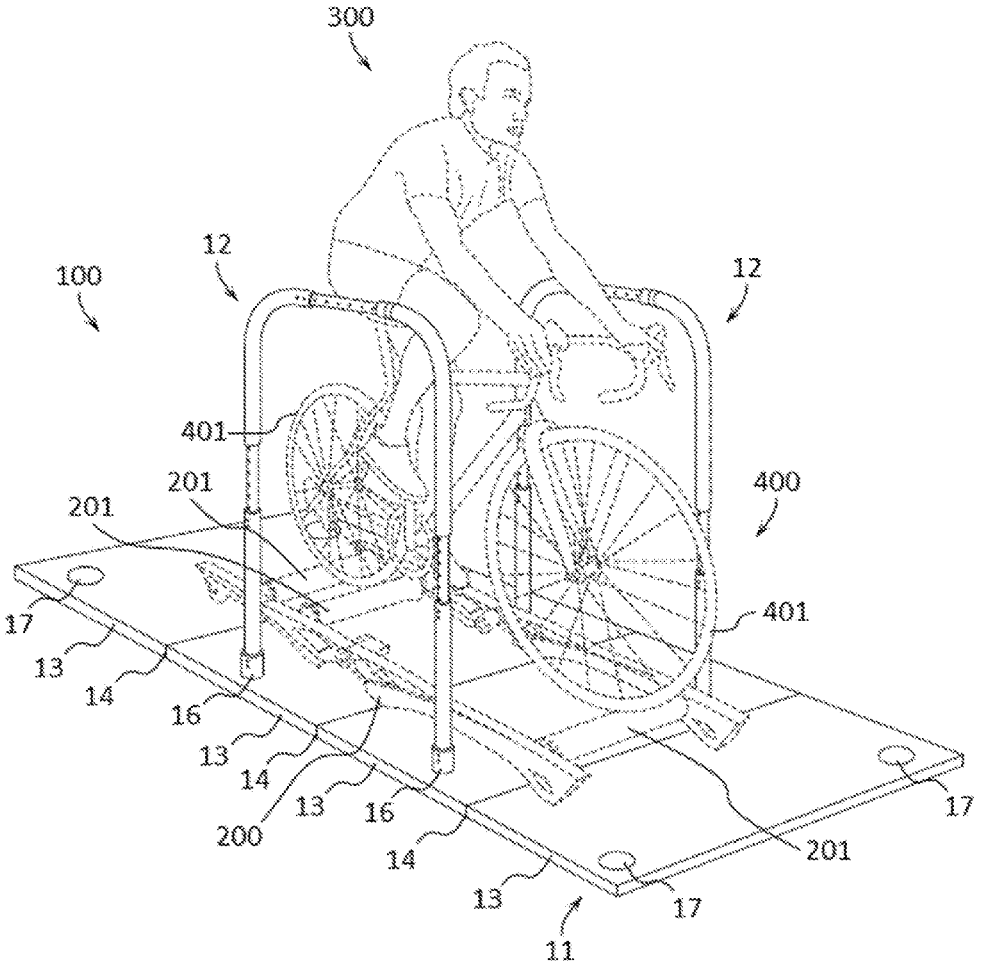
FIG. 1 depicts a perspective view of an example of a training apparatus for stationary bicycle rollers with a cyclist on a bicycle according to various embodiments described herein.

The present invention will now be described by example and through referencing the appended figures representing preferred and alternative embodiments. FIG. 1 illustrates an example of a training apparatus for stationary bicycle rollers ("the apparatus") 100 according to various embodiments. In this example, the apparatus 100 comprises a platform base 11 and two stabilization bars 12. The apparatus 100 is configured to receive a stationary bicycle training device 200 on the platform base 11. Preferably, the stationary bicycle training device 200 may be positioned on the platform base 11 and between the two stabilization bars 12.

A cyclist 300 or user may place a bicycle 400 on the stationary bicycle training device 200 and pedal the bicycle to rotate the wheels 401 of the bicycle 400 and the rollers 201 of the stationary bicycle training device 200. Should the cyclist lose their balance or feel unsteady, the cyclist 300 may grab onto one or both of the stabilization bars 12. Additionally, if the cyclist should fall off of the bicycle 400 and/or the stationary bicycle training device 200, one or both of the stabilization bars 12 may break the fall of the cyclist 300 and bicycle 400 to prevent injury to the cyclist 300, damage to the bicycle 400, and/or damage to surrounding surfaces resulting from the cyclist 300 or bicycle 400 falling off of the stationary bicycle training device 200.

In preferred embodiments and in FIGS. 1, 4, 5, and 6, when in an extended flat configuration, the platform base 11 comprises a generally planar rectangular shape with a longer length than width, and a height that is less than the width. In other embodiments, a platform base 11 may be a plurality of sizes and shapes including "T" shaped, "X" shaped, square shaped, rectangular shaped, circular shaped, cuboid shaped, hexagonal prism shaped, triangular shaped, or any other geometric or non-geometric shape. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention.

Figure 2:
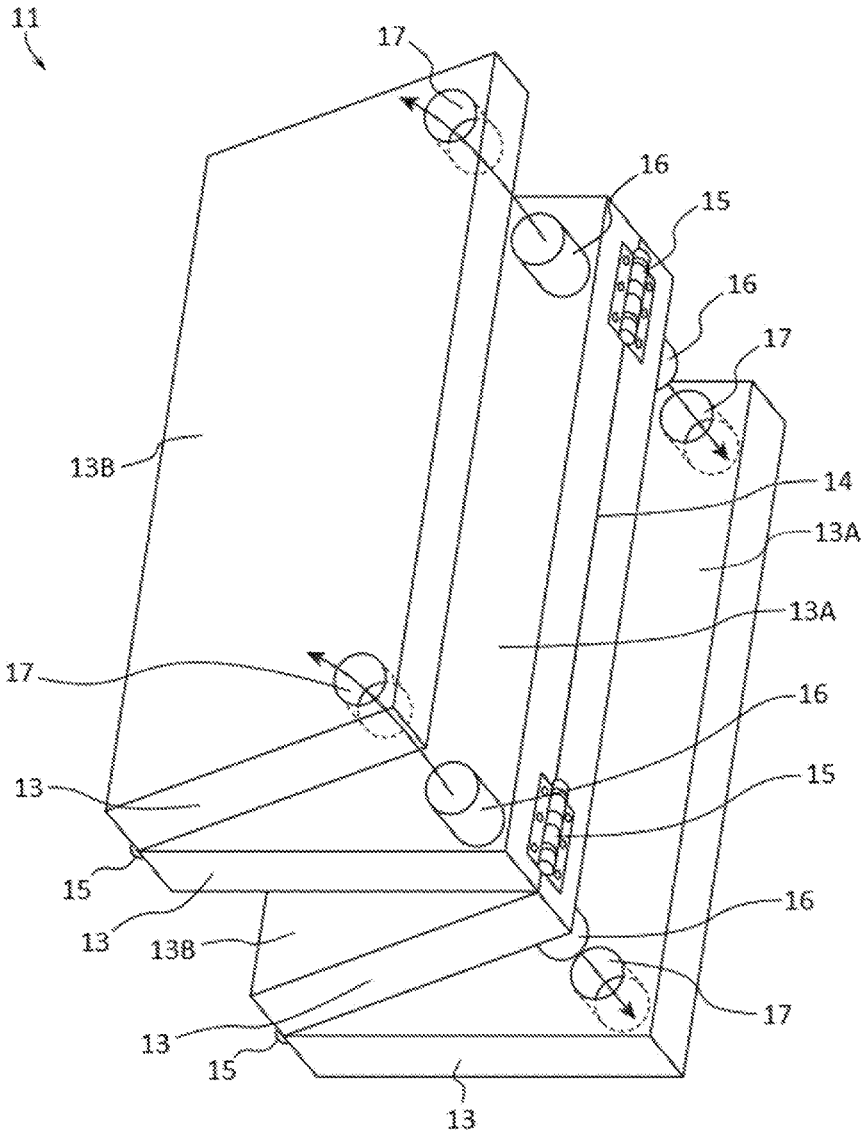
FIG. 2 illustrates a perspective view of an example of a training apparatus platform for stationary bicycle rollers in a partially folded configuration according to various embodiments described herein.

The platform base 11 may comprise one or more base panels 13, each of which may comprise a generally planar upper surface 13A (FIG. 2) and generally planar lower surface 13B (FIG. 2). In preferred embodiments and the embodiment depicted in FIGS. 1, 2, 3, 4, and 6, the platform base 11 may comprise four base panels 13 pivotally connected together at three platform crease 14. In some embodiments, a platform base 11 may comprise two base panels 13 pivotally connected together at a platform crease 14. In other embodiments, a platform base 11 may comprise three base panels 13 pivotally connected together with two platform creases 14. In further embodiments, a platform base 11 may comprise five base panels 13 pivotally connected together with four platform creases 14. In still further embodiments, a platform base 11 may comprise six or more base panels 13 with a first base panel 13 pivotally connected to a second or other base panel 13 at a platform crease 14.

Figure 3:
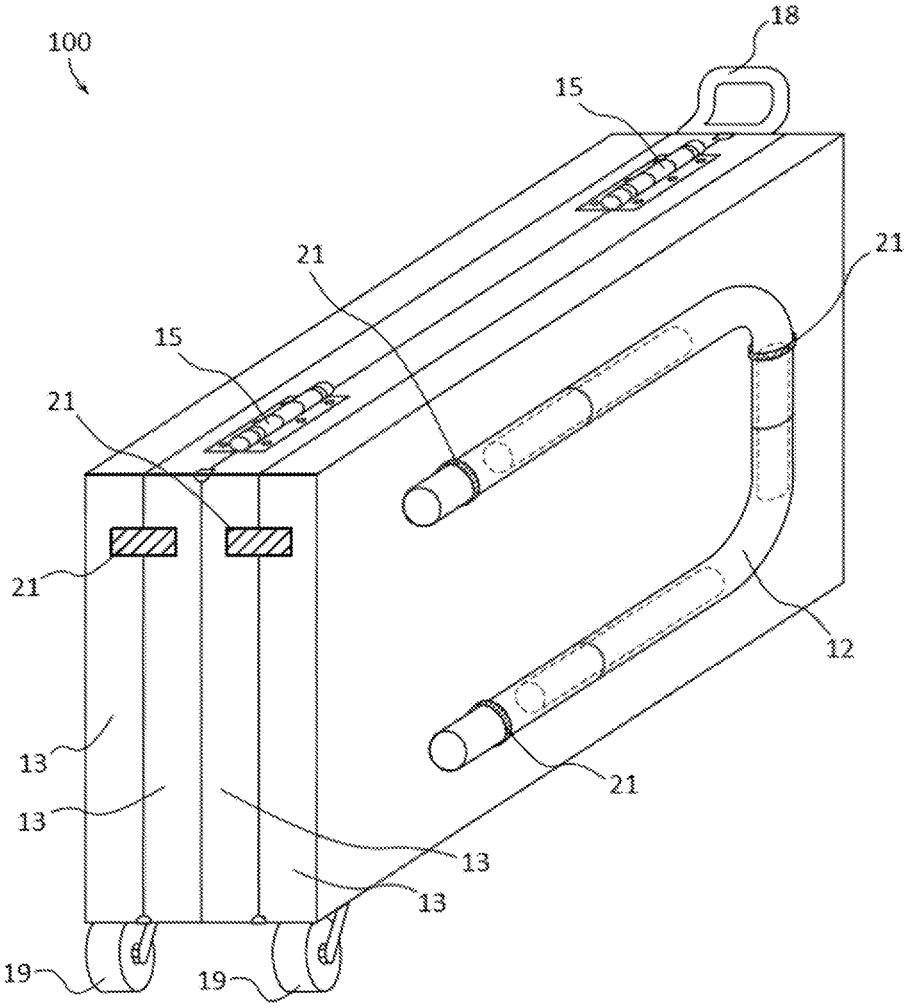
FIG. 3 shows a perspective view of an example of a training apparatus for stationary bicycle rollers in a folded configuration according to various embodiments described herein.

FIG. 2 illustrates a perspective view of an example of a training apparatus for stationary bicycle rollers 100 in a partially folded configuration according to various embodiments described herein. In this embodiment, the platform base 11 of the apparatus 100 is shown transiting between an extended flat configuration (FIGS. 1, 4, 5, and 6) to a folded configuration (FIG. 3). Preferably, a platform base 11 may transition between the two configurations by pivoting the base panels 13 at the platform creases 14. A platform base 11 may be transitioned from an extended flat configuration to a folded configuration by pivoting the base panels 13 at the platform creases 14 until one or more upper surfaces 13A and/or lower surfaces 13B are proximate to, adjacent to, or in contact with each other as shown in FIG. 3. A platform base 11 may be transitioned from a folded configuration to an extended flat configuration by pivoting the base panels 13 at the platform creases 14 until one or more upper surfaces 13A and/or lower surfaces 13B are generally in the same plane with each other as shown in FIGS. 1, 4, 5, and 6.

A first base panel 13 may be pivotally connected to a second base panel 13 with hinge 15 such as a butt hinge, butterfly hinge, flush hinge, barrel hinge, concealed hinge, continuous hinge, T-hinge, strap hinge, double-acting hinge, Soss hinge, a flexible material hinge, or any other suitable type or style of hinge. In preferred embodiments, a platform base 11 comprises one or more hinges 15 connecting a first base panel 13 and a second base panel 13 together.

In preferred embodiments, a stabilization bar 12 (FIGS. 1, 3, 4, 5, and 6) may be temporarily connected to the platform base 11 by one or more receiver members 16. In some embodiments, a receiver member 16 may be substantially permanently joined to a base panel 13 of the platform base 11 by heat bonding, chemical bonding, adhesives, clasp type fasteners, clip type fasteners, rivet type fasteners, threaded type fasteners, other types of fasteners, by being integrally molded or formed together, or any other suitable joining method capable of substantially permanently joining a receiver member 16 to a base panel 13. In other embodiments, a receiver member 16 may be substantially temporarily joined to a base panel 13 of the platform base 11 by being press fit or snap fit together, by one or more fasteners such as Velcro type fasteners, sealable tongue and groove fasteners, clip type fasteners, clasp type fasteners, ratchet type fasteners, threaded type fasteners such as screws and bolts, buckle type fasteners and the like, or any other suitable joining method capable of temporarily securing portions of a receiver member 16 to a base panel 13.

Additionally, a base panel 13 may comprise one or more receiver apertures 17 which are configured to accept and mate with a receiver member 16 on an adjacent base panel 13 when the platform base 11 is positioned in a folded configuration as shown in FIG. 3. In preferred embodiments, a receiver aperture 17 comprises a shape that is complementary to the shape of a receiver member 16 allowing a receiver member 16 to enter and mate with a receiver aperture 17. A receiver aperture 17 on a first base panel 13 and a receiver member 16 on a second panel may be positioned so that when the platform base 11 is positioned into a folded configuration, the receiver aperture 17 may mate with the receiver member 16 allowing the upper surfaces 13A and/or lower surfaces 13B of the first and second base panels 13 to be positioned proximate to, adjacent to, or in contact with each other as shown in FIG. 3.

Turning now to FIG. 3, a perspective view of an example of a training apparatus for stationary bicycle rollers 100 in a folded configuration according to various embodiments described herein. In this example, the apparatus 100 comprises a handle 18, two transportation conveyances 19, and one or more temporary fasteners 21. The apparatus 100 may comprise one or more handles 18 which are configured to be grasped by the hand of a person for facilitating the movement of the apparatus 100. The one or more optional handles 18 may be substantially permanently joined or substantially temporarily joined to the apparatus 100. A handle 18 may comprise a substantially rigid material such as hard plastics, metal, and metal alloys, fiberglass, ceramics, resins, wood, hard rubber, substantially flexible materials such as nylon webbing, cotton webbing, other types of webbing, other types of fabrics, flexible plastics, flexible rubber, or any other material suitable for use as a handle for grasping and facilitating the movement of the apparatus 100.

In some embodiments, the apparatus 100 may comprise one or more transportation conveyances 19 which may be configured to facilitate the movement of the apparatus 100 across a surface when the apparatus is in an extended flat configuration (FIGS. 1, 4, 5, and 6), a partially folded configuration (FIG. 2), and/or a folded configuration (FIG. 3). Preferably, the transportation conveyances 19 are configured to reduce the friction between the apparatus 100 and the surface over which it is desired to be moved without requiring the person moving it to bear the full weight of the apparatus 100. A transportation conveyance 19 may comprise a wheel, a caster wheel, a tread or track, a low friction pad or bumper, a low friction plate, or any other suitable device configured to reduce the friction between the apparatus 100 and the surface over which it is desired to be moved. The one or more optional transportation conveyances 19 may be substantially permanently joined or substantially temporarily joined to the apparatus 100. A transportation conveyances 19 may comprise a substantially rigid material such as hard plastics, metal, and metal alloys, fiberglass, ceramics, resins, wood, hard rubber, substantially flexible materials such as nylon webbing, cotton webbing, other types of webbing, other types of fabrics, flexible plastics, flexible rubber, or any other material suitable for use as a transportation conveyances 19 and facilitating the movement of the apparatus 100.

In some embodiments, the apparatus 100 may comprise one or more temporary fasteners 21 which may be configured to maintain the apparatus 100 in an extended flat configuration (FIGS. 1, 4, 5, and 6), a partially folded configuration (FIG. 2), and/or a folded configuration (FIG. 3). A temporary fastener 21 may be configured to temporarily maintain the apparatus in a desired configuration by temporarily securing a first base panel 13 to a second base panel 13. In preferred embodiments, each base panel may be secured to one or more other base panels 13 by one or more temporary fasteners 21.

In further embodiments, the apparatus 100 may comprise one or more temporary fasteners 21 which may be configured to secure a stabilization bar 12 when the apparatus 100 is positioned in an extended flat configuration (FIGS. 1, 4, 5, and 6), a partially folded configuration (FIG. 2), and/or a folded configuration (FIG. 3). In preferred embodiments, the apparatus 100 may comprise one or more temporary fasteners 21 which may be configured to secure a stabilization bar 12 to an upper surface 13A (FIG. 1) or lower surface 13B (FIG. 1) of a base panel 13.

A temporary fastener 21 may comprise Velcro type fasteners, tongue and groove fasteners, clip type fasteners, clasp type fasteners, ratchet type fasteners, threaded type fasteners such as screws and bolts, buckle type fasteners and the like, or any other suitable joining method capable of temporarily securing portions of a stabilization bar 12 and/or a first base panel 13 to one or more other base panels 13. In preferred embodiments, a first base panel 13 and second base panel 13 are configured to fold proximate to each other into a folded configuration and be removably or temporarily secured to each other with a temporary fastener 21. In further preferred embodiments, platform base 11 comprises one or more temporary fasteners 21 configured to secure a stabilization bar 12 when positioned in the folded configuration.

Figure 4:
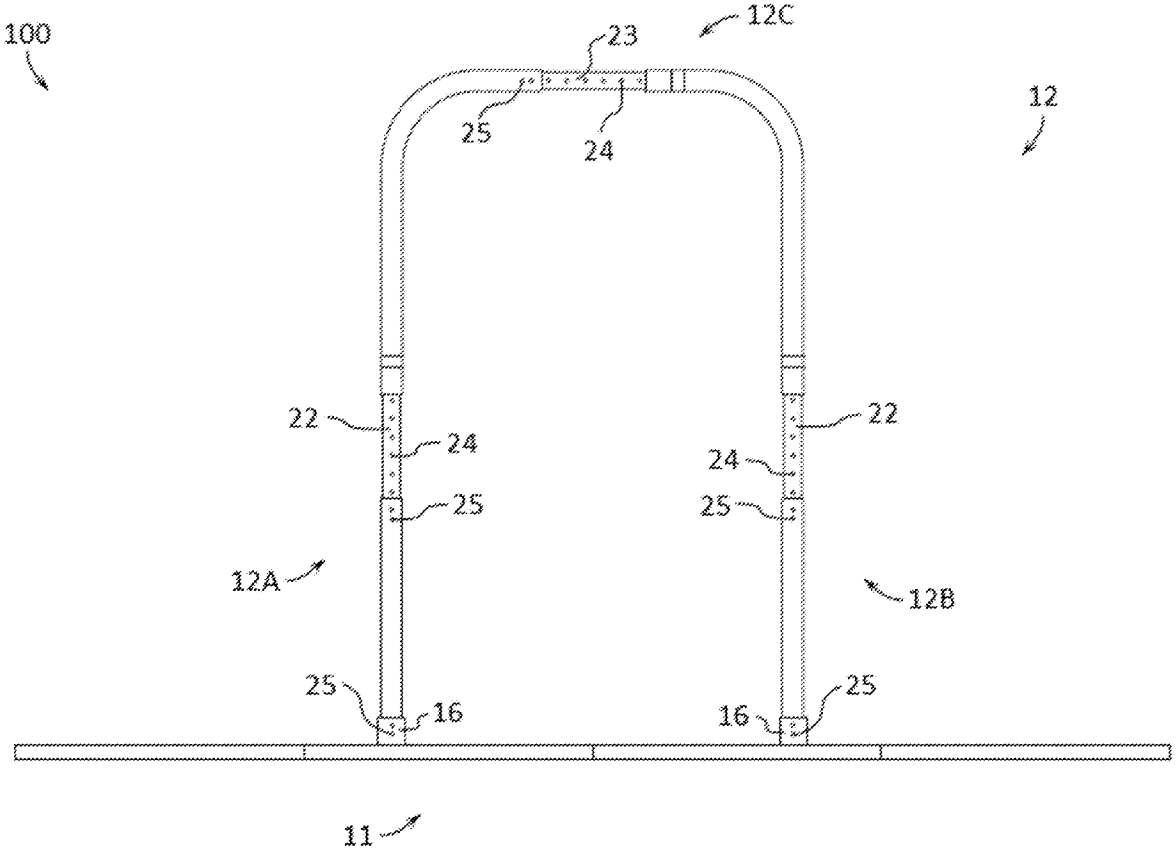
FIG. 4 depicts a side elevation view of an example of a training apparatus for stationary bicycle rollers in an extended flat configuration according to various embodiments described herein.
Figure 5:
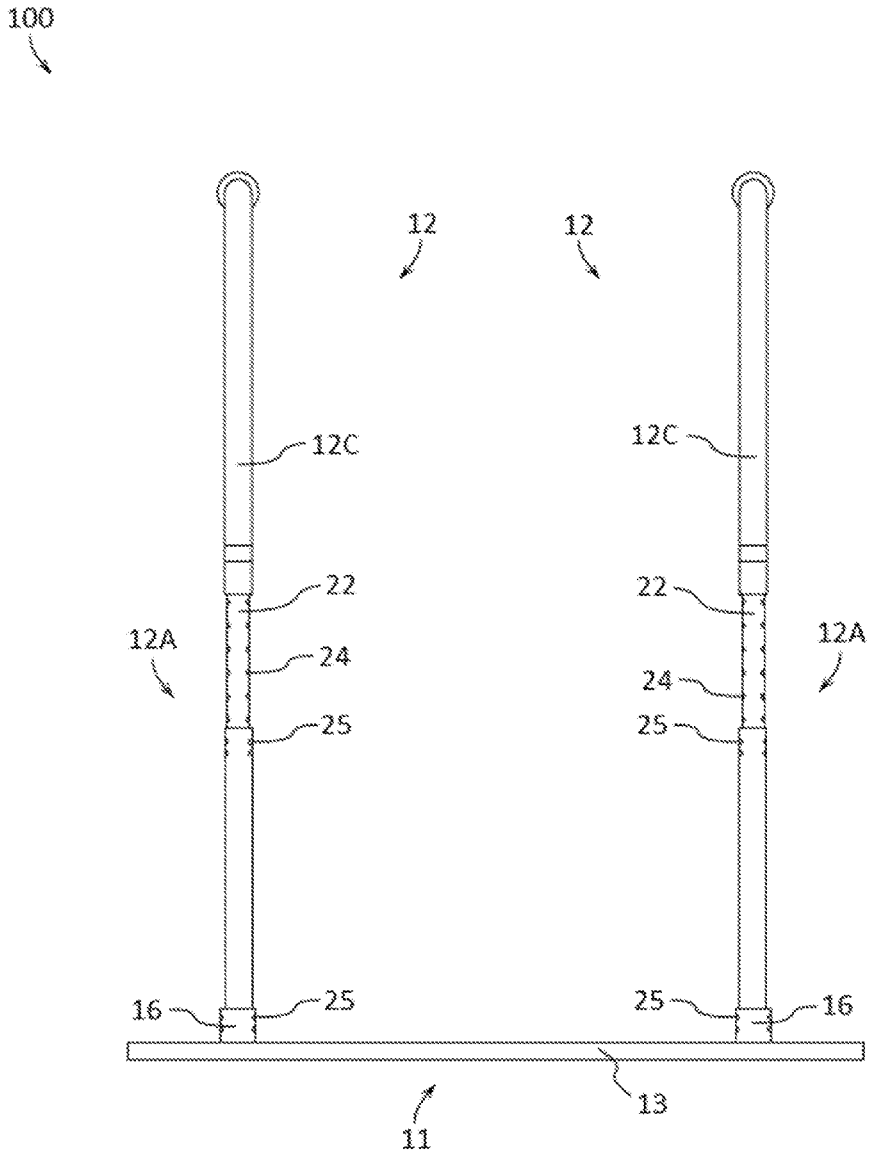
FIG. 5 illustrates a front elevation view of an example of a training apparatus for stationary bicycle rollers in an extended flat configuration according to various embodiments described herein.

Turning now to FIG. 4 which depicts a side elevation view of an example of a training apparatus for stationary bicycle rollers 100 in an extended flat configuration, and FIG. 5 which illustrates a front elevation view of an example of a training apparatus for stationary bicycle rollers 100 in an extended flat configuration according to various embodiments described herein. In this and preferred embodiments, a stabilization bar 12 may comprise a first vertical stabilization bar 12A, a second vertical stabilization bar 12B, and a horizontal stabilization bar 12C. A first vertical stabilization bar 12A, a second vertical stabilization bar 12B, and a horizontal stabilization bar 12C preferably may each be cylindrical or tubular in shape or any other shape and may be made from metal, metal alloys, hard plastics, carbon fiber, fiber glass, or any other substantially rigid material.

A first vertical stabilization bar 12A and a second vertical stabilization bar 12B may each be removably mounted to the platform base 11 with a receiver member 16. In preferred embodiments, a first vertical stabilization bar 12A and a second vertical stabilization bar 12B comprise a shape that is complementary to the shape of a receiver member 16 allowing a first end of a first vertical stabilization bar 12A and a first end of a second vertical stabilization bar 12B to enter and mate with a receiver member 16. In some embodiments, first vertical stabilization bar 12A and a second vertical stabilization bar 12B may each be removably mounted to the platform base 11 with a removable mount such as a threaded screw type connection method, a ball detent method, a push-to-lock type connection method, a turn-to-lock type connection method, a slide-to-lock connection method, or any other suitable temporary connection method as one reasonably skilled in the art could envision to serve the same function.

A horizontal stabilization bar 12C may be removably mounted to a first vertical stabilization bar 12A at one end and to a second vertical stabilization bar 12B at another end. In some embodiments, end portions of a horizontal stabilization bar 12C may comprise a shape that is complementary to the shape of a second end of a first vertical stabilization bar 12A and a second end of a second vertical stabilization bar 12B allowing portions of a first vertical stabilization bar 12A, a second vertical stabilization bar 12B, and/or a horizontal stabilization bar 12C to enter and mate with each other.

In preferred embodiments, a first vertical stabilization bar 12A and/or a second vertical stabilization bar 12B may each comprise a vertical extendable section 22 that is configured to be removably mounted to, enter/mate, retract from, or extend from an end of the horizontal stabilization bar 12C. Also in preferred embodiments, a horizontal stabilization bar 12C may comprise a horizontal extendable section 23 configured to be extendably connected to, enter/mate, retract from, or extend from a portion of the horizontal stabilization bar 12C. A first vertical stabilization bar 12A, a second vertical stabilization bar 12B, a horizontal stabilization bar 12C, a vertical extendable section 22, and/or a horizontal extendable section 23 may each comprise one or more detent apertures 24 and/or one or more retractable balls 25 configured to function as in a ball detent mechanical arrangement which may provide an extendable and retractable connection allowing the stabilization bar 12 to extend and retract both horizontally and vertically, although other suitable mechanical arrangements may be used such as a threaded screw type connection method, a push-to-lock type connection method, a turn-to-lock type connection method, a slide-to-lock connection method, or any other suitable temporary connection method as one reasonably skilled in the art could envision to serve the same function.

For example, a first vertical stabilization bar 12A may be extendably connected to the horizontal stabilization bar 12C. The first vertical stabilization bar 12A may comprise a plurality of detent apertures 24 on its vertical extendable section 22, and the horizontal stabilization bar 12C may comprise a retractable ball 25. The retractable ball 25 may be a single, usually metal sphere, sliding within a bored cylinder in the horizontal stabilization bar 12C, against the pressure of a spring, which pushes the retractable ball 25 against the vertical extendable section 22, which carries the detent apertures 24—which can be as simple as a hole of smaller diameter than the retractable ball 25. When the detent aperture 24 is in line with the cylinder, the retractable ball 25 falls partially into the detent aperture 24 under spring pressure, holding the first vertical stabilization bar 12A and the horizontal stabilization bar 12C at that position. Additional force applied to the retractable ball 25 on the horizontal stabilization bar 12C will push the retractable ball 25 back into its cylinder, compressing the spring, and allowing the first vertical stabilization bar 12A and the horizontal stabilization bar 12C to extend or retract to another position.

In another example, a horizontal stabilization bar 12C may comprise a horizontal extendable section 23 configured to enter/mate, retract from, or extend from a portion of the horizontal stabilization bar 12C. The horizontal extendable section 23 may comprise a plurality of detent apertures 24, and the horizontal stabilization bar 12C may comprise a retractable ball 25. The retractable ball 25 may be a single, usually metal sphere, sliding within a bored cylinder in the horizontal stabilization bar 12C, against the pressure of a spring, which pushes the retractable ball 25 against the horizontal extendable section 23, which carries the detent apertures 24—which can be as simple as a hole of smaller diameter than the retractable ball 25. When the detent aperture 24 is in line with the cylinder, the retractable ball 25 falls partially into the detent aperture 24 under spring pressure, holding the vertical extendable section 22 and the horizontal stabilization bar 12C at that position. Additional force applied to the retractable ball 25 on the horizontal stabilization bar 12C will push the retractable ball 25 back into its cylinder, compressing the spring, and allowing the vertical extendable section 22 and the horizontal stabilization bar 12C to extend or retract to another position.

In a similar manner a receiver member 16 may be configured to removably mate with a first 12A or second 12B vertical stabilization bar. A receiver member 16, a first vertical stabilization bar 12A, and/or a second vertical stabilization bar 12B may comprise a retractable ball 25 and/or one or more detent apertures 24 configured to function as in a ball detent mechanical arrangement which may provide a temporary connection allowing a first 12A or second 12B vertical stabilization bar to removably mate with a receiver member 16, although other suitable mechanical arrangements may be used.

For example, a first vertical stabilization bar 12A may be removably mated to a receiver member 16. The first vertical stabilization bar 12A may comprise a detent aperture 24 on the end opposite its vertical extendable section 22, and the receiver member 16 may comprise a retractable ball 25. The retractable ball 25 may be a single, usually metal sphere, sliding within a bored cylinder in the receiver member 16, against the pressure of a spring, which pushes the retractable ball 25 against the first vertical stabilization bar 12A, which carries the detent apertures 24—which can be as simple as a hole of smaller diameter than the retractable ball 25. When the detent aperture 24 is in line with the cylinder, the retractable ball 25 falls partially into the detent aperture 24 under spring pressure, holding the first vertical stabilization bar 12A and the receiver member 16 in a mated position. Additional force applied to the retractable ball 25 on the receiver member 16 will push the retractable ball 25 back into its cylinder, compressing the spring, and allowing the first vertical stabilization bar 12A and the receiver member 16 to be unmated and separated.

Figure 6:
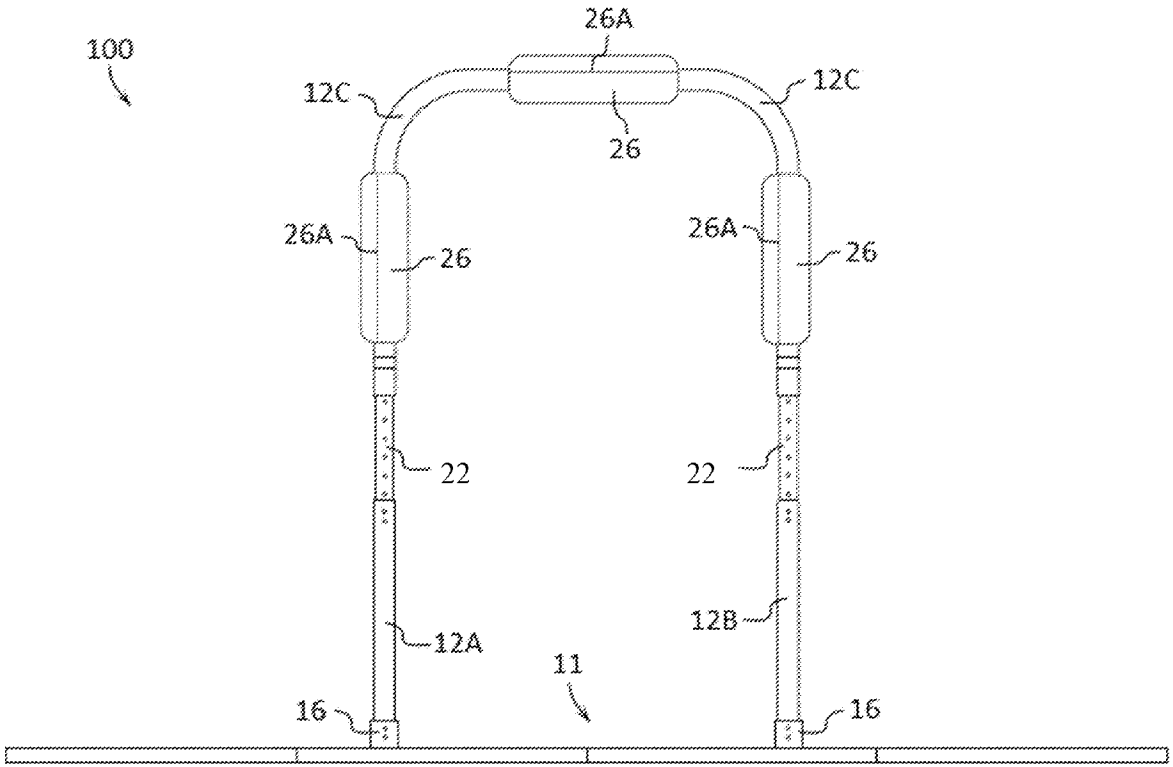
FIG. 6 shows a side elevation view of an example of a training apparatus for stationary bicycle rollers in an extended flat configuration according to various embodiments described herein.

FIG. 6 shows a side elevation view of an example of a training apparatus for stationary bicycle rollers 100 in an extended flat configuration according to various embodiments described herein. In this embodiment, the horizontal stabilization bar 12C comprises three optional padding members 26. A padding member 26 may optionally be positioned anywhere on a first vertical stabilization bar 12A, second vertical stabilization bar 12B, and/or horizontal stabilization bar 12C and may be made from neoprene, plastic, rubber, silicone, nylon, or any suitable soft flexible material. In some embodiments, a padding member 26 may be permanently joined to a first vertical stabilization bar 12A, second vertical stabilization bar 12B, and/or horizontal stabilization bar 12C. In other embodiments, a padding member 26 may be temporarily joined to a first vertical stabilization bar 12A, second vertical stabilization bar 12B, and/or horizontal stabilization bar 12C. A padding member 26 may comprise a slit 26A that extends the length of the padding member 26 configured to allow the padding member 26 to temporarily wrap around a first vertical stabilization bar 12A, second vertical stabilization bar 12B, and/or horizontal stabilization bar 12C.

The elements that comprise the apparatus 100 may be made from durable materials such as hard plastics, metal alloys, wood, hard rubbers, carbon fiber, or any other suitable materials including combinations of materials. Additionally, one or more elements may be made from durable and slightly flexible materials such as soft plastics, silicone, soft rubbers, or any other suitable materials including combinations of materials.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A training apparatus configured to receive a stationary bicycle training device while in an extended flat configuration and transition to a folded configuration, the apparatus comprising:

a. a platform base comprising a first base panel having a first receiver aperture and a second receiver aperture and a second base panel having a first receiver member and a second receiver member, wherein said second base panel is pivotally connected to said first base panel;

b. a first vertical stabilization bar removably mounted to said platform base;

c. a second vertical stabilization bar removably mounted to said platform base;

d. a horizontal stabilization bar removably mounted to said first vertical stabilization bar and said second vertical stabilization bar, and configured to provide support for a cyclist operating a bicycle; and wherein said first receiver member of the second base panel is positioned within said first receiver aperture of the first base panel while the apparatus is in the folded configuration, and said first receiver member of the second base panel is spaced apart from said first receiver aperture of the first base panel while the apparatus is in the extended flat configuration.

2. The training apparatus of claim 1, wherein the first base panel and second base panel are configured to fold onto each other and transition from the extended flat configuration to the folded configuration.

3. The training apparatus of claim 2, wherein the platform base contains a platform crease located between said first base panel and said second base panel.

4. The training apparatus of claim 2, wherein the platform base contains a hinge connecting said first base panel and said second base panel.

5. The training apparatus of claim 1, wherein the first vertical stabilization bar is extendably connected to the horizontal stabilization bar through a vertical extendable section.

6. The training apparatus of claim 5, wherein the vertical extendable section comprises a plurality of detent apertures.

7. The training apparatus of claim 6, wherein the vertical extendable section comprises a retractable ball configured to mate within one of said plurality of detent apertures.

8. The training apparatus of claim 1, wherein the horizontal stabilization bar contains a horizontal extendable section.

9. The training apparatus of claim 8, wherein the horizontal extendable section comprises a plurality of detent apertures.

10. The training apparatus of claim 9, wherein the horizontal extendable section comprises a retractable ball configured to mate within one of said plurality of detent apertures.

11. The training apparatus of claim 1, wherein the first receiver member is configured to removably mate with the first vertical stabilization bar when the platform base is positioned in the extended flat position.

12. The training apparatus of clam 11, wherein the first receiver aperture is configured to accept and mate with the first receiver member when the platform base is positioned in the folded configuration.

13. The training apparatus of claim 1, wherein the first base panel and second base panel are configured to fold proximate to each other into the folded configuration and be temporarily secured to each other with a temporary fastener.

14. The training apparatus of claim 13, wherein the platform base comprises a second temporary fastener configured to secure the first vertical stabilization bar to said platform base when positioned in the folded configuration.

15. The training apparatus of claim 13, wherein the platform base comprises a second temporary fastener configured to secure the horizontal stabilization bar to said platform base when positioned in the folded configuration.

16. The training apparatus of claim 13, wherein the platform base comprises a transportation conveyance adapted to assist in the transportation and movement of the apparatus when in the folded configuration.

17. The training apparatus of claim 16 wherein the transportation conveyance is a caster wheel.

18. A training apparatus for a cyclist, the training apparatus comprising:

a roller configured to contact a bicycle wheel;

a platform base positioned below said roller with said platform base comprising a first platform base panel and a second platform base panel pivotally connected to said first platform base panel;

a first vertical stabilization bar removably mounted to said platform base;

a second vertical stabilization bar removably mounted to said platform base;

a horizontal stabilization bar removably mounted to said first vertical stabilization bar and said second vertical stabilization bar, and configured to provide support for the cyclist operating a bicycle;

a first receiver member protruding above an upper surface of the second platform base panel with said first receiver member configured to temporarily connected with the first vertical stabilization bar;

a first receiver aperture positioned within the first platform base panel, said first receiver aperture configured to receive said first receiver member when the apparatus is in a folded configuration and said first receiver aperture configured to be spaced apart from said first receiver member when the apparatus is in an extended flat configuration; and wherein said first platform base panel is configured to fold onto said second platform base panel when the apparatus is transitioning from the extended flat configuration to the folded configuration.

* * * * *